US008014709B2

(12) United States Patent
Aoi

(10) Patent No.: US 8,014,709 B2
(45) Date of Patent: Sep. 6, 2011

(54) IMAGE FORMING DEVICE

(75) Inventor: Yosuke Aoi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 22 days.

(21) Appl. No.: 12/358,732

(22) Filed: Jan. 23, 2009

(65) Prior Publication Data

US 2009/0189340 A1 Jul. 30, 2009

(30) Foreign Application Priority Data

Jan. 30, 2008 (JP) ..... 2008-018588

(51) Int. Cl.
*B65H 5/36* (2006.01)

(52) U.S. Cl. ..... 399/316; 399/388; 271/264

(58) Field of Classification Search ..... 271/264; 399/316, 388
See application file for complete search history.

(56) References Cited

U.S. PATENT DOCUMENTS

| | | | | |
|---|---|---|---|---|
| 4,882,606 | A * | 11/1989 | Deguchi | 399/316 |
| 5,424,818 | A * | 6/1995 | Yoshimura et al. | 399/313 |
| 5,453,823 | A * | 9/1995 | Hashizume et al. | 399/316 |
| 5,455,663 | A | 10/1995 | Inoue et al. | |
| 5,617,193 | A * | 4/1997 | Ban et al. | 399/316 |
| 5,740,512 | A | 4/1998 | Hayashi et al. | |
| 7,272,351 | B2 * | 9/2007 | Murrell et al. | 399/316 |
| 7,596,346 | B2 * | 9/2009 | Kurosu et al. | 399/316 |
| 7,636,100 | B2 * | 12/2009 | Maebashi | 347/153 |
| 7,706,734 | B2 * | 4/2010 | Higashimura et al. | 399/316 |
| 2005/0201782 | A1 * | 9/2005 | Fuchiwaki et al. | 399/316 |
| 2008/0030808 | A1 * | 2/2008 | Oyama et al. | 358/498 |

FOREIGN PATENT DOCUMENTS

| | | |
|---|---|---|
| JP | 5-11632 | 1/1993 |
| JP | 9-175685 | 7/1997 |
| JP | 11-349182 | 12/1999 |
| JP | 2005-84329 | 3/2005 |

* cited by examiner

*Primary Examiner* — Stefanos Karmis
*Assistant Examiner* — Luis A Gonzalez
(74) *Attorney, Agent, or Firm* — Scully Scott Murphy & Presser, PC

(57) ABSTRACT

An image forming device includes a conveyor belt, an image forming unit, and a guide unit. The conveyor belt has a conveying surface that mounts and conveys a recording medium. The image forming unit forms an image on the recording medium placed on the conveying surface. The guide unit supports and conveys the recording medium to the conveying surface in a conveying direction. The guide unit includes a first guide plate and a second guide plate. The first guide plate is flexible. The first guide plate has a first distal end portion at a downstream side thereof in the conveying direction and is disposed near the conveyor belt. The second guide plate is flexible. The second guide plate has a second distal end portion disposed in direct confrontation with the first distal end portion to nip the recording medium in cooperation with the first distal end portion.

12 Claims, 5 Drawing Sheets

IMAGE FORMING DEVICE

CROSS REFERENCE TO RELATED APPLICATION

This application claims priority from Japanese Patent Application No. 2008-013588 filed Jan. 30, 2008. The entire content of this priority application is incorporated herein by reference.

TECHNICAL FIELD

The present invention relates to an image forming device including a guide member that guides a recording sheet to a conveying surface of a conveyer belt.

BACKGROUND

A conventional image forming device includes a conveyor belt for conveying a recording sheet and an image forming unit such as a process unit disposed in confrontation with a conveying surface of the conveyor belt for forming an image on a surface of the recording sheet conveyed by the conveyor belt. In the image forming device described above, if the recording sheet placed on the conveyor belt should be uniformly flat or smooth otherwise wrinkles are generated on the recording sheet causing lack of any part of the image formed on the recording sheet.

To solve this problem, U.S. Pat. No. 5,740,512 discloses an image forming device that has a guide member guiding the recording sheet from obliquely above to a conveying surface of conveyor belt. The guide member is provided with a projection protruding from a center portion of the guide member in a widthwise direction of the recording sheet toward the conveying surface of conveyor belt. Widthwise center region of the recording sheet is pressed by the projection toward the conveying surface of conveyor belt, and then, the center region of recording sheet is brought with contact with the conveying surface, and then, the contact with the conveying surface gradually proceeds toward the widthwise edge regions of the recording sheet. As a result, no air is involved or trapped between the conveying surface of the conveyor belt and the recording sheet when the recording sheet is placed on the conveying surface. Thus the recording sheet can be placed on the conveying belt with the surface of recording sheet being smoothed uniformly.

However, the inventor of the present application found degradation of output image in the image forming device disclosed in U.S. Pat. No. 5,740,512, if a plurality of recording sheets are stacked in highly humid condition (especially, in high-temperature and high-humidity condition) for long periods of time.

Specifically, in such highly-humid condition, a center region of each sheet maintains dried condition whereas an outline region thereof becomes moist. In other words, the center region has stiffness or linearity higher than that of the outline region.

Therefore, when such a recording sheet is conveyed by a roller, a center region of the recording sheet is conveyed ahead of the widthwise end regions in a conveying direction, due to the difference in stiffness, wrinkles may be generated in the widthwise end regions. In addition, when this recording sheet conveys into the guide member of the image forming device disclosed in U.S. Pat. No. 5,740,512, the preceding center region is pressed toward the conveying belt by the guide member and conveyed downstream prompting difference in sheet conveying manner between the center region and the widthwise end regions. Consequently, generation of wrinkles at the widthwise end regions is promoted or assisted. As a result, a gap is formed between the recording sheet and the conveying surface of conveyor belt due to the wrinkles when the recording sheet is placed on the conveyor belt, and the gap adversely affects image quality due to insufficient discharge of the air from the gap.

SUMMARY

In view of the foregoing, it is an object of the present invention to provide an image forming device capable of preventing degradation in image quality even if the widthwise end regions of the recording sheet is moist.

In order to attain the above and other objects, the invention provides an image forming device including a conveyor belt, an image forming unit, and a guide unit. The conveyor belt has a conveying surface that mounts and conveys a recording medium. The image forming unit forms an image on the recording medium placed on the conveying surface. The guide unit supports and conveys the recording medium to the conveying surface in a conveying direction. The guide unit includes a first guide plate and a second guide plate. The first guide plate is flexible. The first guide plate has a first distal end portion at a downstream side thereof in the conveying direction and is disposed near the conveyor belt. The second guide plate is flexible. The second guide plate has a second distal end portion disposed in direct confrontation with the first distal end portion to nip the recording medium in cooperation with the first distal end portion.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
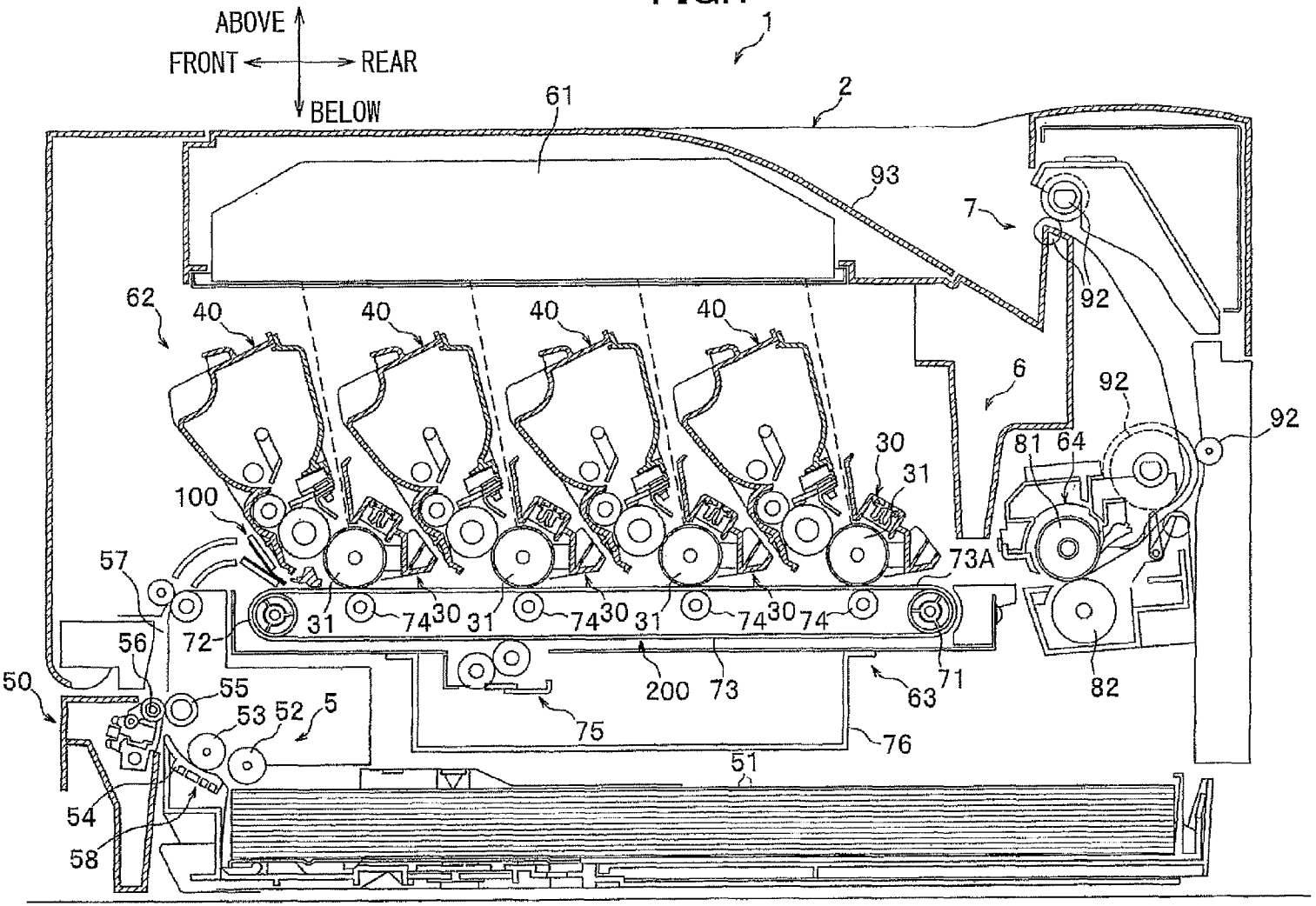
FIG. 1 is a cross-sectional view showing an overall construction of a color laser printer as an image forming device according to an embodiment of the invention.

An image forming device according to an embodiment of the invention will be described while referring to the accompanying drawings wherein like parts and components are designated by the same reference numerals to avoid duplicating description. In this embodiment, the image forming device of the invention is applied to a color laser printer 1 as shown in FIG. 1.

Note that in the following description, the expressions "front," "rear," "left," "right," "above," and "below" are used to define the various parts when the color laser printer 1 is disposed in an orientation in which it is intended to be used. Also, a widthwise direction of the color laser printer 1 implies a widthwise direction of a recording sheet, the direction being perpendicular to a sheet feeding direction.

As shown in FIG. 1, the color laser printer 1 includes a main casing 2, a sheet supplying unit 5 for supplying a recording sheet 51 as a recording medium, an image forming unit 6 for forming an image on the recording sheet 51, and a discharge section 7 for discharging the recording sheet 51 formed with image.

The sheet supplying unit 5 includes a sheet supply tray 50 that is detachably mounted in the main casing 2 and a sheet supplying mechanism 58 for supplying recording sheets 51 from the sheet supply tray 50 to the image forming unit 6.

The sheet supplying mechanism 58 is disposed near the front end of the sheet supply tray 50, and includes a sheet supply roller 52, a separation roller 53, a separation pad 54, a paper dust removing roller 55, and a pinch roller 56. An uppermost recording sheet 51 of a sheet stack on the sheet supply tray 50 is separated from the sheet stack and in an upward direction through cooperative operation of the sheet supply roller 52, the separation roller 53, and the separation pad 54. As the recording sheet 51 fed in the upward direction passes between the paper dust removing roller 55 and the pinch roller 56, paper dust is removed from the recording sheet 51. Then, the recording sheet 51 is conveyed along a conveying path 57 while the conveying direction of the recording sheet 51 is changed to a rearward direction of the color laser printer 1. Subsequently, the recording sheet 51 is conveyed in a guide unit 100 and supplied onto a conveyor belt 73. The guide unit 100 will be later described in detail.

The image forming unit 6 includes a scanner unit 61, a process unit 62, a transfer unit 63, and a fixing unit 64.

The scanner unit 61 is disposed in an upper section of the main casing 2. Although not shown in the drawings, the scanner unit 61 includes four sub-scanning units each corresponding to one of four colors cyan, magenta, yellow, and black. Each of the sub-scanning units includes a laser emitting section, a polygon mirror, a plurality of lenses, and a reflecting mirror. The laser emitting section emits a laser beam, which is scanned at a high speed by the polygon mirror in the left-to-right direction and passes through and is reflected by the plurality of lenses and the reflecting mirror so as to irradiate a surface of a corresponding photosensitive drum 31 described later.

The process unit 62 is disposed between the scanner unit 61 and the transfer unit 63, and includes a plurality of (four) sub-drum units 30 and a plurality of (four) developing cartridges 40 corresponding to the sub-drum units 30. Each sub-drum unit 30 includes the photosensitive drum 31 and a Scorotron charger (not shown), and each developer cartridge 40 includes a developing roller (not shown).

In the process unit 62, the laser beam emitted from the scanner unit 61 based on desired image data forms an electrostatic latent image on the surface of the photosensitive drum 31, and a toner image corresponding to the electrostatic latent image is formed on the surface of the photosensitive drum 31 when toner is supplied to the electrostatic latent image by the developing roller of the developing cartridge 40.

The transfer unit 63 includes a driving roller 71, a driven roller 72, the conveyor belt 73, a plurality of transfer rollers 74, and a cleaning unit 75.

The driving roller 71 and the driven roller 72 are disposed in parallel with and separated from each other. The conveyor belt 73 is an endless belt disposed over the driving roller 71 and the driven roller 72. An outer surface of the conveyor belt 73 serves as a conveying surface 73A and contacts each of the photosensitive drums 31. The transfer rollers 74 are disposed in opposition to the corresponding photosensitive drums 31 via the conveyor belt 73, and are applied with transfer bias from a high-voltage circuit board (not shown). During the image forming operation, the conveying surface 73A mounts and conveys the recording medium. Subsequently, the recording sheet 51 conveyed by the conveyor belt 73 is held between the photosensitive drum 31 and the transfer roller 74 via the conveyor belt 73, whereby a toner image is transferred from the photosensitive drum 31 onto the recording sheet 51.

The cleaning unit 75 is disposed below the conveyor belt 73 for removing toner adhered to the conveyor belt 73. A toner accumulation section 76 is disposed below the cleaning unit 75 for accumulating toner removed by the cleaning unit 75.

The fixing unit 64 includes a heating roller 81 and a pressure roller 82. The fixing unit 64 thermally fixes toner images onto the recording sheet 51 while the recording sheet 51 passes between the heating roller 81 and the pressure roller 82. A discharge tray 93 is provided onto which the recording sheet 51 fixed by the fixing unit 64 is discharged. A conveying roller 92 is disposed between the fixing unit 64 and the discharge tray 93 for directing the recording sheet 51 to the discharge tray 93.

Figure 2A:
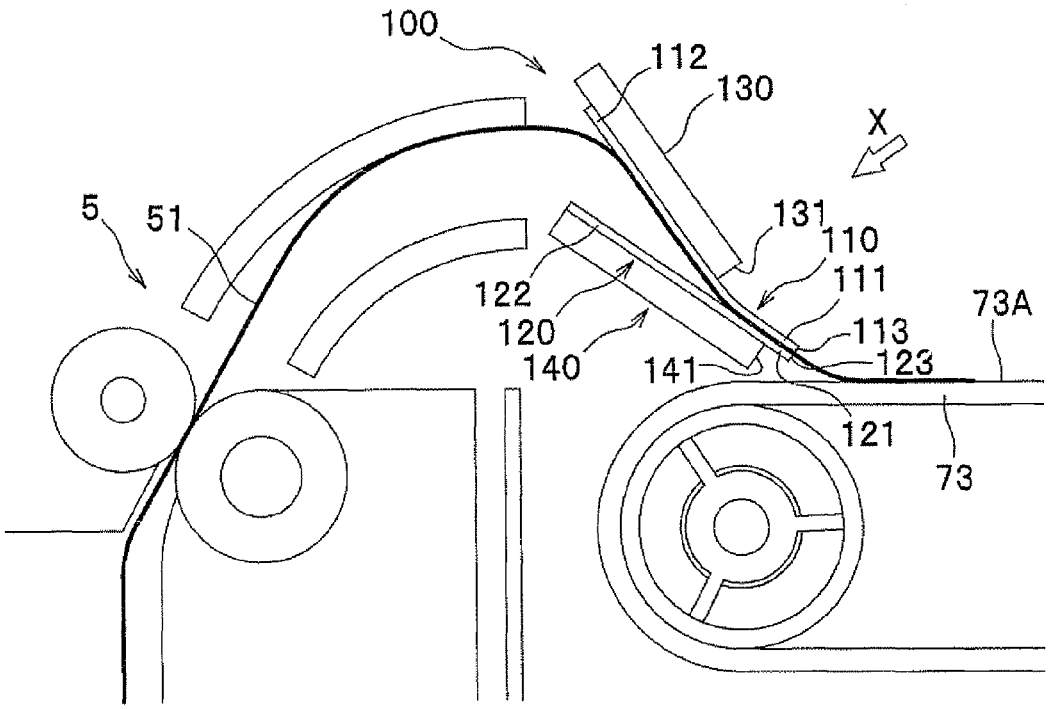
FIG. 2A is a cross-sectional view showing a guide member of the image forming device.

The guide unit 100 will next be described in detail. As shown in FIG. 2A, the guide unit 100 includes a pair of guide plates (an upper guide plate 110 and a lower guide plate 120) and a pair of support portions (an upper support portion 130 and a lower support portion 140) for guiding (supporting and conveying) the recording sheet 51 toward the conveying surface 73A of the conveyor belt 73. The upper guide plate 110 is disposed above the lower guide plate 120. The upper support portion 130 is disposed above the lower support portion 140.

The upper guide plate 110 and lower guide plate 120 are flexible sheet members, and each of guide plates 110 and 120 has distal end portion 111 and 121 at their downstream sides in the conveying direction (near the conveyor belt 73A), and base portion 112 and 122 at their upstream sides, respectively. The base portions 112 and 122 are supported on the support portions 130 and 140, respectively, so that the distal end portions 111 and 121 protrude, for a predetermined length, from the support portions 130 and 140 as a flexible free end portions, respectively. A distance between the upper guide plate 110 and lower guide plate 120 is gradually reduced toward the distal end portions 111 and 121 to form a V-shaped configuration with the distal end portions 111 and 121 contacting with each other for nipping the recording sheet 51 between the distal end portions 111 and 121 only. In other words, the distal end portion 121 is dispose in direct confrontation with the distal end portion 111 to nip the recording sheet 51 in cooperation with the distal end portion 111.

Figure 2B:
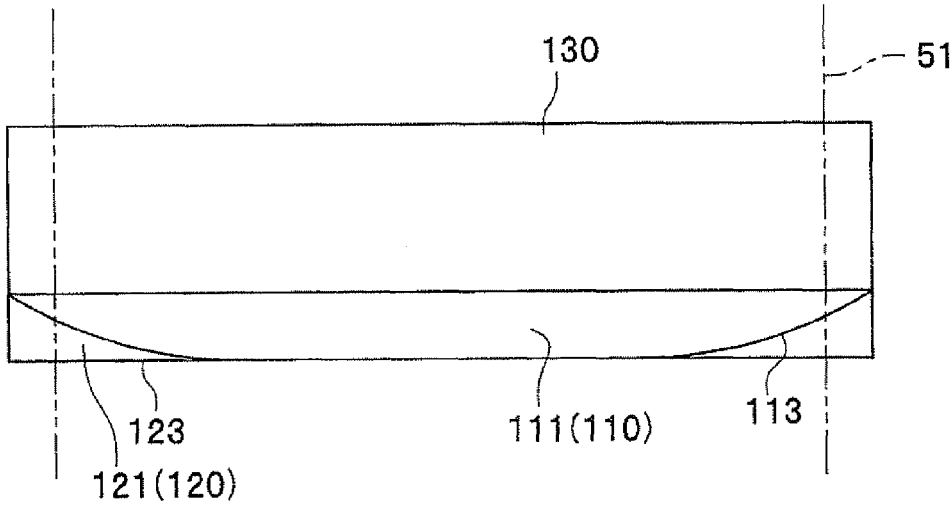
FIG. 2B is a view showing the guide member as viewed from a direction indicated by an arrow X in FIG. 2A.

As shown in FIG. 2B, each of the upper guide plate 110 and lower guide plate 120 has width larger than that of the recording sheet 51. The distal end portion 111 of upper guide plate 110 has a distal end 113 forming a substantially arcuate shape whose widthwise center portion protruding toward more downstream than both widthwise end portions. The distal end portion 121 of lower guide plate 120 has a linear distal end 123 extending in the widthwise direction and aligned with the widthwise center portion of the distal end 113. In other words, widthwise ends of the distal end 123 of the lower guide plate 120 protrudes toward more downstream than that of the distal end 113 of the upper guide plate 110.

As shown in FIG. 2A, the support portions 130 and 140 are disposed so as to form a gap therebetween. The gap gradually becomes smaller from upstream toward downstream in the conveying direction. The lower support portion 140 has a downstream end portion 141 protruding toward more downstream in the conveying direction than the downstream end portion 131 of the upper support portion 130. Therefore, the lower guide plate 120 supported on the lower support portion 140 provides a stiffness higher than that of the upper guide plate 110 supported on the upper support portion 130. That is, the upper support potion 130 is more flexible than the lower support portion 140.

Incidentally, the upper support portion 130 and lower support portion 140 can be formed in an integral unit, for example, a tubular member having a rectangular cross-section has opposing walls, one serving as the upper support potion 130, and the other serving as the lower support portion 140. Alternatively, the support portion 130 and 140 can be formed by separate plate members.

Next, an operation of the guide unit 100 will be described. As shown in FIG. 2A, the recording sheet 51 conveyed from the sheet supplying unit 5 first contacts near the base portion 112 of upper guide plate 110, and then the recording sheet 51 are conveyed along a lower surface of the upper guide plate 110. Subsequently, the recording sheet 51 is nipped between the distal end portions 111 and 121. Accordingly, if wrinkles are generated on the recording sheet 51, the wrinkles are removed from the recording sheet 51 by nipping between the upper guide plate 110 and lower guide plate 120.

If a center region of the recording sheet 51 in the widthwise direction maintains dried condition whereas an outline region thereof become moist, the center region of recording sheet 51 is conveyed ahead of the widthwise end regions in the conveying direction by conventional image forming devices. However, the guide unit 100 can provide uniform conveying speed at an entire leading end of the recording sheet 51. Specifically, the preceding center region of recording sheet 51 is subjected to friction by nipping between the center portions of both the upper guide plate 110 and lower guide plate 120. At the time, the following widthwise end regions of recording sheet 51 is released from the friction at a timing faster than the release timing of the center region, because the widthwise end of upper guide plate 110 is disposed upstream than that of the lower guide plate 120 in the conveying direction. Accordingly, the widthwise end regions of recording sheet 51 can catch up to the center region subjected to the friction, and then the center region and the both widthwise end regions of the recording sheet 51 can be aligned linearly when the recording sheet 51 is conveyed to the conveyor belt 73.

As described above, according to the present embodiment, since the recording sheet is nipped between the distal end portions 111 and 121, the wrinkles can be removed so that the recording sheet 51 placed on the conveying surface 73A of conveyor belt 73 can be uniformly flat or smooth even if the widthwise end regions of the recording sheet 51 is moist. Therefore, degradation in image quality can be avoided even if the widthwise end regions of the recording sheet 51 is moist.

Also, since the widthwise center portion of upper guide plate 110 protrudes toward downstream, the guide unit 100 can impart frictional braking force to the widthwise center region of recording sheet 51 between the upper guide plate 110 and lower guide plate 120. Therefore, the leading edge of the recording sheet 51 becomes linear extending in direction perpendicular to the sheet conveying direction before the recording sheet 51 is placed on the conveying surface 73A of conveyor belt 73. Thus, generation of wrinkles caused by the preceding center region of recording sheet 51 can be avoided. Therefore, degradation in image quality due to the wrinkles can be avoided.

In addition, since the widthwise ends of lower guide plate 120 is disposed downstream than that of the upper guide plate 110, the widthwise end regions of recording sheet 51 can be supported on the width wise end portions of the lower guide plate 120, thereby preventing the widthwise end regions from hanging down. In other words, since the guide unit 100 can provide uniform conveying speed at the entire leading end of recording sheet 51, it is possible to prevent air from being involved or trapped between the conveying surface 73A and the widthwise center region of recording sheet 51 due to the widthwise end regions of the recording sheet 51 contacting with the conveying belt 73 at a timing faster than a contacting timing of widthwise center region.

Further, since the downstream end portion 141 of lower support member 140 is disposed more downstream than the downstream end portion 131 of upper support member 130, the lower guide plate 120 has stiffness higher than that of the upper guide plate 110. Accordingly, the lower guide plate 120 can guide the recording sheet 51 toward the conveyor belt 73 in the uniform conveying direction. Further, since the lower guide plate 120 has sufficient stiffness, the lower guide plate 120 can reliably support the recording sheet 51 to stabilize conveying direction of recording sheet 51.

In the above described embodiment, the widthwise center portion of distal end 113 of the upper guide plate 110 is disposed more downstream than the widthwise end portions in the above embodiment. However, as a modification, such arrangement can be applied to the lower guide plate 120. For example, in the lower guide plate 120, a widthwise center potion at the distal end can be disposed more downstream than widthwise end portions. Alternatively, both guide plates 110 and 120 can have distal ends 113 and 123 whose widthwise center portions are disposed more downstream than widthwise end portions. Further, while the distal end 113 of upper guide member 110 is formed into a substantially arcuate shape in the embodiment, the distal end 113 can be formed other than arcuate shape such as a substantial triangular shape.

Next, an upper guide plate 210 according to a first modification of the embodiment will be described with reference to FIG. 3A. The upper guide plate 210 includes a distal end portion 213 having a widthwise center portion 213A and both widthwise end portions 213B. The widthwise end portions 213B are provided by forming notches at the both widthwise end portions. Thus, the widthwise center portion 213A protrudes more downstream in the conveying direction than the widthwise end portions 213B. In other words, the widthwise end portion 213B has linear edges positioned more upstream than that of the widthwise center portion 213A.

Figure 3A:
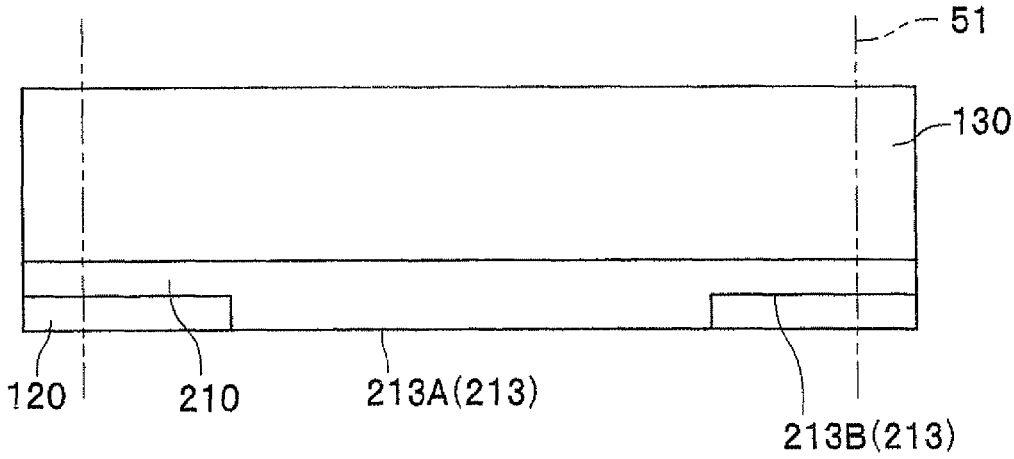
FIG. 3A is a view showing a guide member according to a first modification.
Figure 3B:
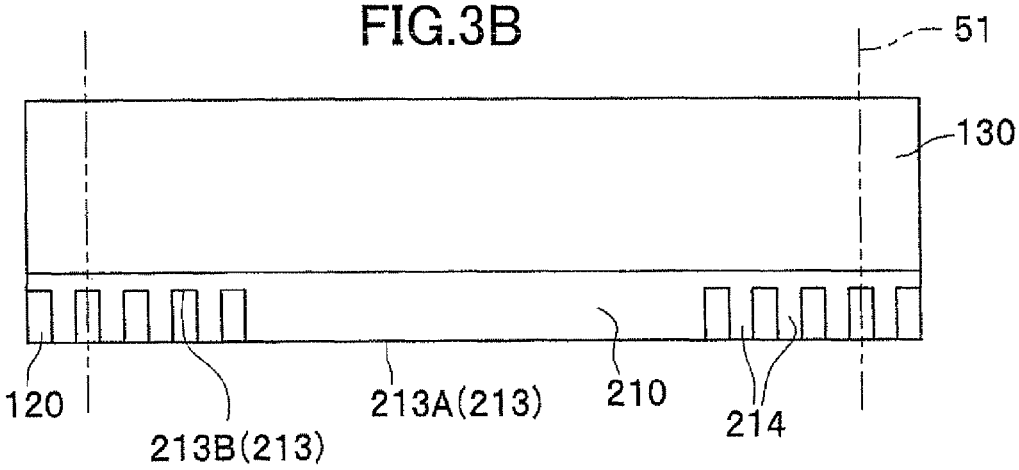
FIG. 3B is a view showing a guide member according to a second modification.

A second modification is shown in FIG. 3B, where the widthwise end portions 213B can be provided with a plurality of projections 214. In other words, the widthwise end portions 213B are formed with a plurality of recesses.

According to the upper guide plates 210 shown in FIGS. 3A and 3B, the widthwise center portion 213A can impart friction larger than the widthwise end portions 213B. Therefore, the preceding running of widthwise center region of recording sheet 51 can be prevented.

Figure 3C:
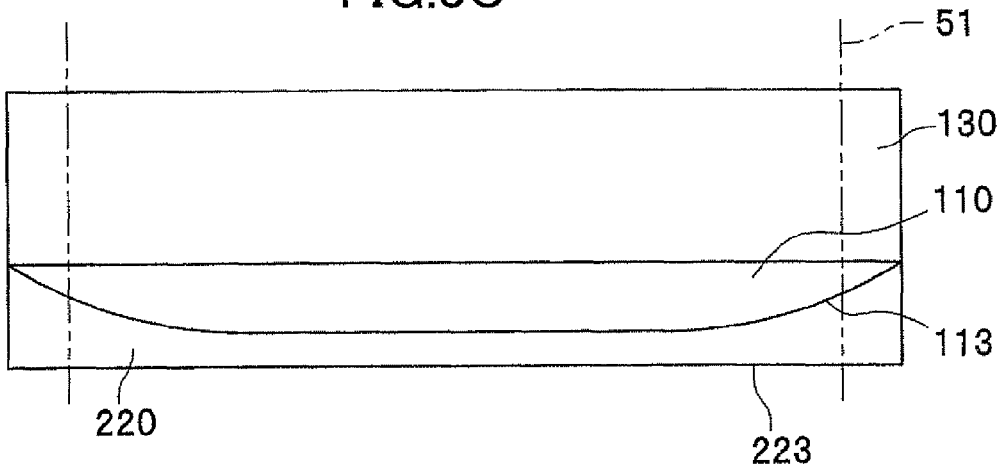
FIG. 3C is a view showing a guide member according to a third modification.

Next, a lower guide plate 220 according to a third modification will be described with reference to FIG. 3C. In the foregoing embodiment, the distal end 123 of lower guide plate 120 is aligned with the widthwise center portion of distal end 113 of upper guide plate 110. However, in the third modification, the lower guide plate 220 has a distal end 223 that protrudes more downstream in the conveying direction than the widthwise center portion of distal end 113. With this construction, a leading edge of recording sheet 51 can be supported on the lower guide plate 220 after the leading edge has moved past the distal end 113 of upper guide plate 110. Therefore, hanging of the leading edge of recording sheet 51 can be prevented, and the recoding sheet 51 can be directed to the conveyor belt 73 at a suitable angle.

Figure 4A:
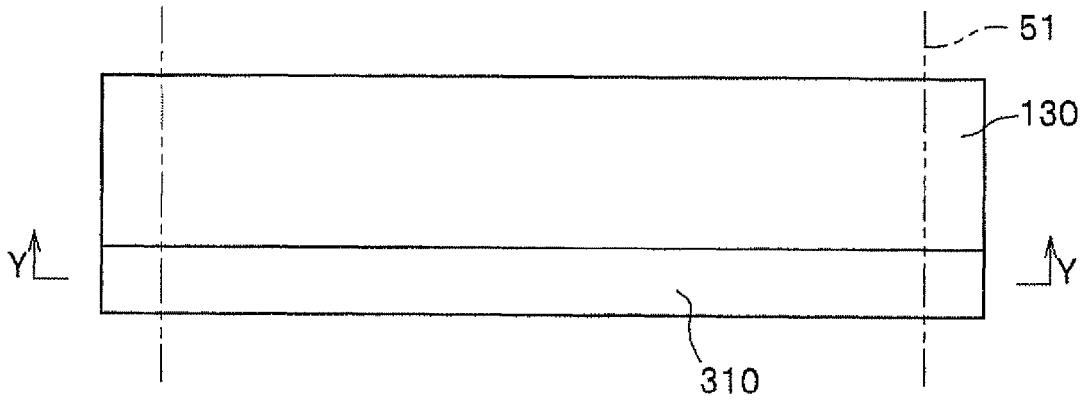
FIG. 4A is a view showing a guide member according to is a fourth modification.

While the distal end 113 of upper guide plate 110 is formed into a substantially arcuate shape in the foregoing embodiment, the distal end 113 can be formed into a shape other than arcuate shape such as a substantially rectangular shape as shown in FIG. 4A which pertains to a fourth modification.

Figure 4B:
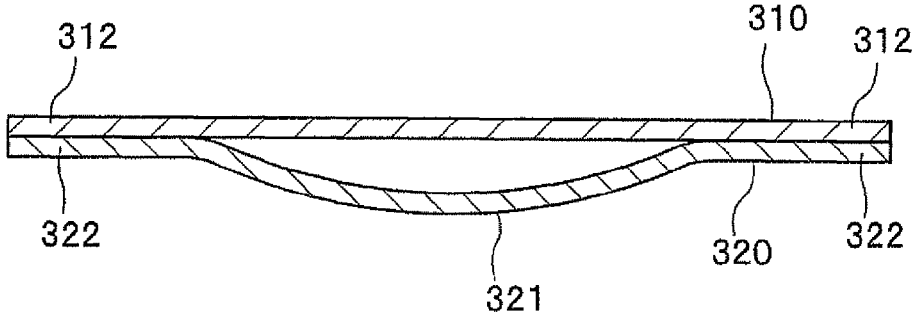
FIG. 4B is a cross-sectional view taken along the line Y-Y in FIG. 4A showing the guide member according to the fourth modification.

An upper guide plate 310 and lower guide plate 320 according to the fourth modification will be described with reference to FIGS. 4A and 4B. The upper guide plate 310 and lower guide plate 320 are formed of a sheet like member having a substantially rectangular shape. The lower guide plate 320 includes a concave part 321 and widthwise end portions 322. The concave part 321 is disposed at the widthwise center portion of the lower guide plate 320 at a downstream side thereof in the conveying direction. The concave part 321 is concaved downward than the widthwise end portions 322 taken along the line Y-Y in FIG. 4A. The widthwise end portions 322 are disposed in contact with the widthwise end portions 312 of the upper guide plate 310. That is a distance between the upper guide plate 310 and the concave part 321 is greater than a distance between the widthwise end portions 312 and 322.

With this construction, the widthwise center region of recording sheet 51 hangs down in conformance with the curvature of the concave part 321, and the widthwise end regions are nipped between the widthwise end portions 312 and 322. Accordingly, the widthwise end portions 312 and 322 can remove the wrinkles generated at the widthwise end regions of the recording sheet 51.

The widthwise center region of recording sheet 51 is brought into contact with the conveyor belt 73 as viewed in a vertical direction. And then, the contact with the conveyor belt 73 gradually proceeds toward the widthwise end regions of the recording sheet 51. As a result, no air is involved or trapped between the conveying surface 73A of the conveyor belt 73 and the recording sheet 51 when the recording sheet is placed on the conveying surface 73A Thus, the recording sheet 51 can be placed on the conveying surface 73A with the surface of recording sheet 51 being smoothed uniformly.

Figure 5:
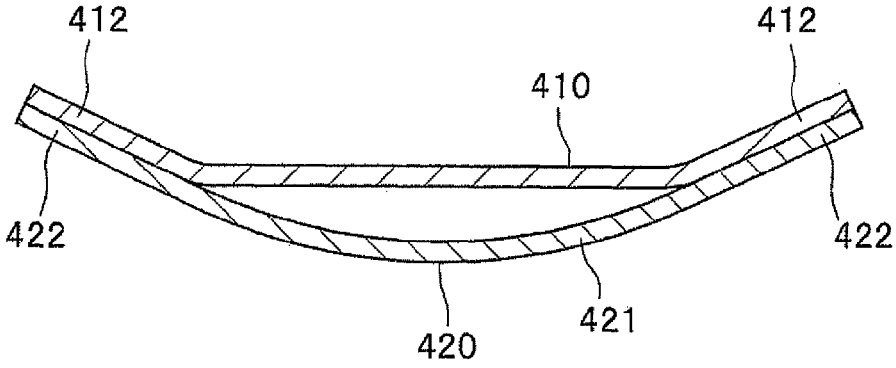
FIG. 5 is a cross-sectional view showing a guide member according to a fifth modification.

Next, an upper guide plate 410 and a lower guide plate 420 according to a fifth modification will be described with reference to FIG. 5. The lower guide plate 420 has a widthwise center portion 421 and widthwise end portions 422. The lower guide plate 420 is gradually sloped upward from the widthwise center portion 421 toward the widthwise end portions 422 to form a V-shape. The upper guide plate 410 has a horizontal widthwise center portion 411 and slanted widthwise end portions 412 bent from the widthwise center portion 411 so that the widthwise end portions 412 extend along the widthwise end portions 412. According to the fifth modification, the recording sheet 51 is curved along an upper surface of the lower guide plate 420. Therefore, the contact with the conveyor belt 73 can gradually proceed toward the widthwise end regions of the recording sheet 51 as viewed in the vertical direction.

Figure 6:
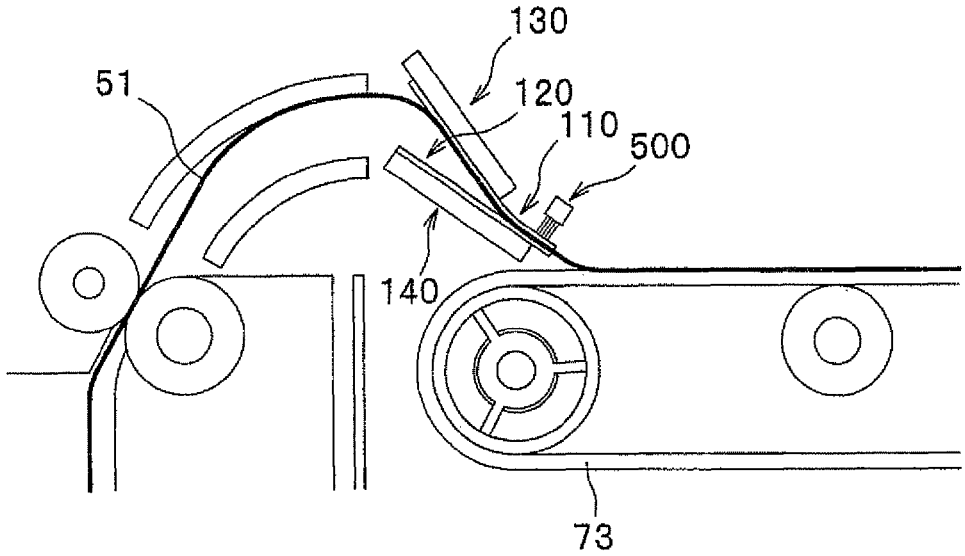
FIG. 6 is a cross-sectional view showing a guide member according a sixth modification.

A sixth modification is shown in FIG. 6, where an electrification removal brush 500 is disposed in contact with an upper surface of the upper guide plate 110. With this construction, since the electrification removal brush 500 removes electricity charge from the recording sheet 51, the generation of wrinkles due to static cling of the recording sheet 51 to the conveyor belt 73 can be prevented.

Alternatively, the electrification removal brush 500 can be disposed in contact with any one of the lower guide plate 120, the upper support portion 130, and the lower support portion 140. Further, an electrification erasing member made from SUS (stainless steel) can be used instead of the electrification removal brush 500.

Figure 7:
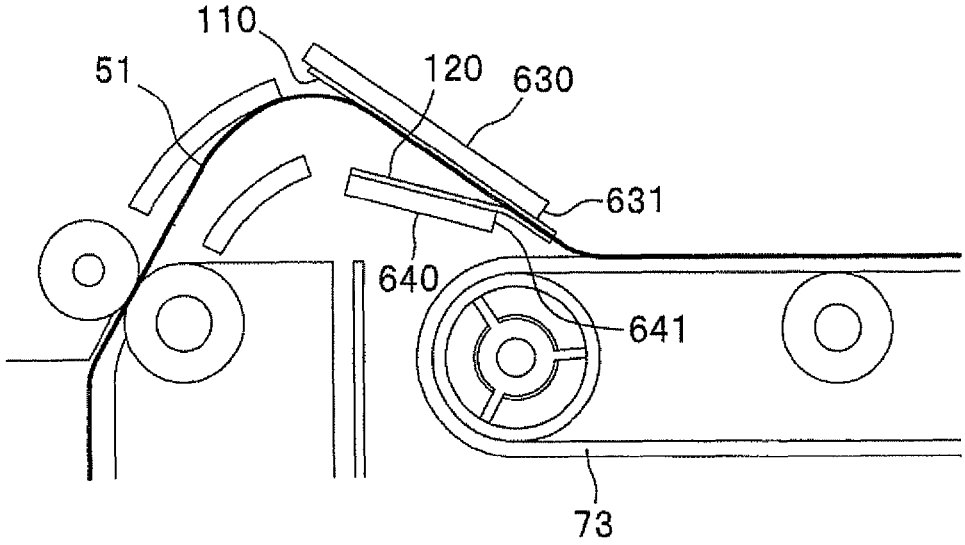
FIG. 7 is a cross-sectional view showing a guide member according a seventh modification.

Next, an upper support portion 630 protrudes and a lower support portion 640 according to a seventh modification will be described with reference to FIG. 7. In the above-described embodiment, the downstream end portion 141 of the lower support portion 140 protrudes toward more downstream in the conveying direction than the downstream end portion 131 of the upper support portion 130.

However, in the seventh modification, a downstream end portion 631 of the upper support portion 630 protrudes toward more downstream in the conveying direction than a downstream end portion 641 of the lower support portion 640. With this construction, the upper guide plate 110 suspended from the upper support portion 630 provides a stiffness higher than that of the lower guide plate 120 supported on the lower support portion 640. Accordingly, the upper guide plate 110 can guide the recording sheet 51 toward the conveyor belt 73 to stabilize conveying direction of the recording sheet 51.

While the invention has been described in detail with reference to the embodiment and modifications thereof, it would be apparent to those skilled in the art that various changes and variations may be made therein without departing from the spirit of the invention.

The above embodiment pertains to the color laser printer 1. However, the invention is also applicable to other image forming devices, such as photocopiers or multifunction devices.

Further, various kind of the recording sheet 51 are available such as be a thick sheet of paper, a thin sheet of paper, a postcard, an OHP sheet, or the like.

What is claimed is:

1. An image forming device comprising:

a conveyor belt having a conveying surface on which a recording medium is mounted, the conveying surface conveying the recording medium;

an image forming unit that forms an image on the recording medium placed on the conveying surface; and a guide unit that supports and conveys the recording medium to the conveying surface in a conveying direction, the guide unit comprising:

a first guide plate that is flexible and having a first distal end portion at a downstream side thereof in the conveying direction and disposed near the conveyor belt; and a second guide plate that is flexible and having a second distal end portion disposed in direct confrontation with the first distal end portion to nip the recording medium in cooperation with the first distal end portion, wherein each of the first distal end portion and the second distal end portion has widthwise center portion and widthwise end portions in a widthwise direction perpendicular to the conveying direction, and wherein the first distal end portion and the second distal end portion are configured to provide a nipping force for nipping the recording medium at the widthwise end portions smaller than that at the widthwise center portion.

2. The image forming device according to claim 1, wherein the first distal end portion has a first widthwise center portion and first widthwise end portions, and the second distal end portion has a second widthwise center portion and the second widthwise end portions, at least one of the first widthwise center portion and the second widthwise center portion protruding toward more downstream than one of the first widthwise end portions and the second widthwise end portions continuing the protruding widthwise center portion.

3. The image forming device according to claim 2, wherein the first widthwise center portion protrudes toward more downstream than the first widthwise end portions, and wherein the second guide plate is disposed below the first guide plate, and the second widthwise end portions protrude toward more downstream than the first widthwise end portions.

4. The image forming device according to claim 3, wherein the first widthwise center portion has a first linear edge, and the first widthwise end portion have an arcuate edge, and wherein the second distal end portion has a second linear edge in alignment with the first linear edge.

5. The image forming device according to claim 3, wherein the first widthwise center portion has a first linear edge, and the first widthwise end portions has a pair of second linear edges positioned more upstream than the first linear edge; and wherein the second distal end portion has a third linear edge in alignment with the first linear edge.

6. The image forming device according to claim 3, wherein the first widthwise center portion has a first linear edge, and the first widthwise end portions has a plurality of recesses; and wherein the second distal end portion has a second linear edge in alignment with the first linear edge.

7. The image forming device according to claim 3, wherein the second distal end portion protrudes toward more downstream in the conveying direction than the first widthwise center portion.

8. The image forming device according to claim 7, wherein the first widthwise center portion has a first linear edge, and the first widthwise end portion have an arcuate edge, and wherein the second distal end portion has a second linear edge positioned more downstream than the first linear edge.

9. The image forming device according to claim 1, wherein the first distal end portion has a first widthwise center portion and first widthwise end portions in a widthwise direction perpendicular to the conveying direction; and wherein the second guide plate is disposed below the first guide plate, the second distal end portion having a second widthwise center portion formed into concaved shape spaced away from the first widthwise center portion, and second widthwise end portions in contact with the first widthwise end portions.

10. The image forming device according to claim 1, further comprising:

a first support member that supports the first guide plate and has a first downstream end positioned at downstream side thereof in the conveying direction;

a second support member that supports the second guide plate and has a second downstream end positioned at downstream side thereof in the conveying direction and protruding more downstream than the first downstream end.

11. The image forming device according to claim 10, wherein the second support member is disposed below the first support member.

12. The image forming device according to claim 1, further comprising an eraser in contact with one of the first distal end portion and the second distal end portion for removing electric charge from one of the first guide plate and the second guide plate.

* * * * *